US006267278B1

(12) United States Patent
Bogart

(10) Patent No.: US 6,267,278 B1
(45) Date of Patent: Jul. 31, 2001

(54) ARCHERY BOW HOLDER

(76) Inventor: Terry W. Bogart, 8510 NE. 108th Ter., Kansas City, MO (US) 64157

( * ) Notice: Subject to any disclaimer, the term of this patent is extended or adjusted under 35 U.S.C. 154(b) by 0 days.

(21) Appl. No.: 09/513,561

(22) Filed: Feb. 25, 2000

(51) Int. Cl.[7] ..... A45C 13/30

(52) U.S. Cl. ..... 224/222; 224/242; 224/270; 224/677; 224/916

(58) Field of Search ..... 224/149, 222, 224/661, 677, 678, 242, 246, 249, 250, 267, 268, 270, 916, 922

(56) References Cited

U.S. PATENT DOCUMENTS

| | | | | |
|---|---|---|---|---|
| D. 260,674 | | 9/1981 | Simmons et al. . | |
| D. 282,271 | * | 1/1986 | Morrell | D22/107 |
| D. 291,503 | * | 8/1987 | Hayes | D3/221 |
| D. 300,989 | * | 5/1989 | Kovach | D3/221 |
| D. 354,393 | * | 1/1995 | Mocca | D3/221 |
| 1,043,675 | * | 11/1912 | Crockett | 144/286.5 |
| 2,781,958 | * | 2/1957 | Lewandowski | 224/246 |
| 3,208,653 | | 9/1965 | Wallace . | |
| 3,232,501 | * | 2/1966 | Merenda | 224/194 |
| 4,103,807 | | 8/1978 | Lyon et al. . | |
| 5,482,241 | | 1/1996 | Oglesby . | |
| 5,619,981 | | 4/1997 | Breedlove . | |
| 5,850,955 | | 12/1998 | Barr . | |
| 5,934,531 | * | 8/1999 | Jablonic et al. | 224/222 |

OTHER PUBLICATIONS

1999 Sales Catalog of Papa D's Discount Archery Outlet, of Lansing, Michigan, p. 36, exact publication date unknown, but as least one year prior to the filing of the present application.

* cited by examiner

*Primary Examiner*—S K Cronin
(74) *Attorney, Agent, or Firm*—Shughart Thomas & Kilroy P.C.; Kent R. Erickson

(57) ABSTRACT

An archery bow holder having leg straps for fastening the bow holder to the calf of an archer, and a folding bow support member for supporting a lower end of a compound archery bow with a first receiver to accept an eccentric wheel thereof and a second receiver for receiving the tip of a recurve type archery bow; the bow support member being moveable between retracted and operating positions and having a brace for holding it in the operating position and a lock for holding it in the retracted position. Also included is a bowstring retainer which is designed to selectively engage the bowstring of an archery bow resting on the bow support fork. Further included is a stabilizer which is moveable between an operating position where the stabilizer engages the archer's foot and prevents the bow holder from twisting around the archer's leg and a traveling position where the stabilizer folds back around the archer's ankle so that the archer can walk unimpeded.

22 Claims, 2 Drawing Sheets

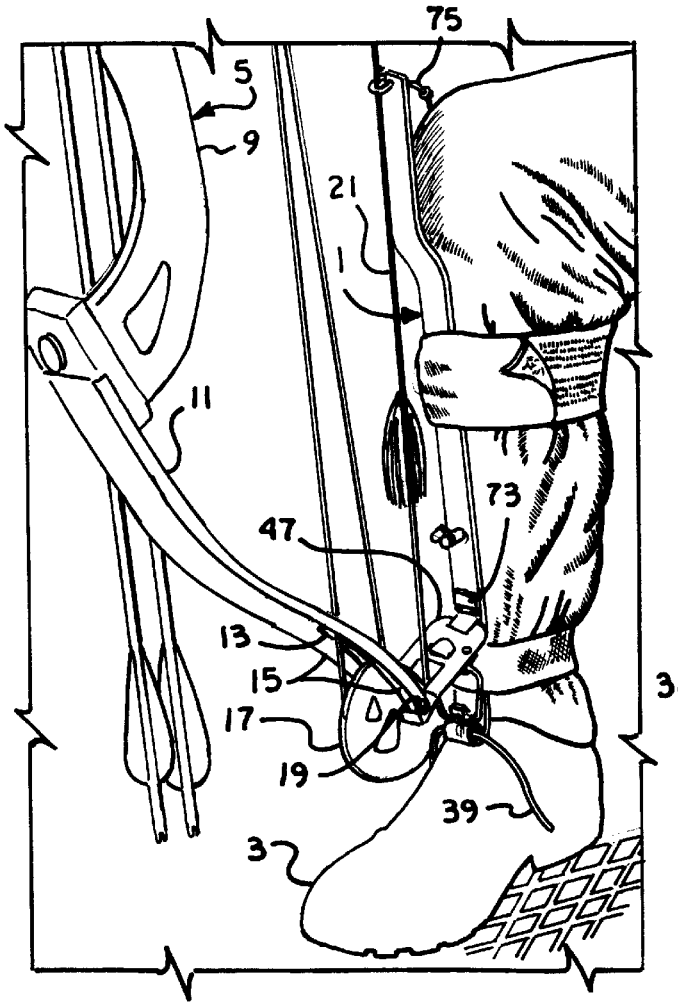
Fig.1.
Fig.2.
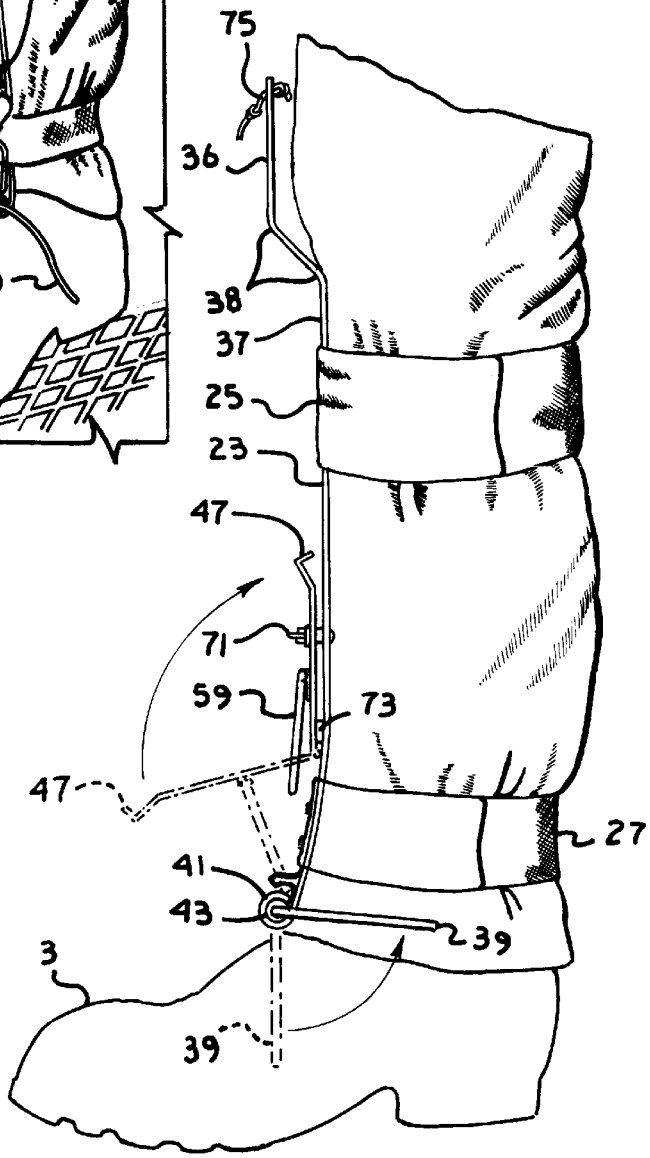
Fig.6.
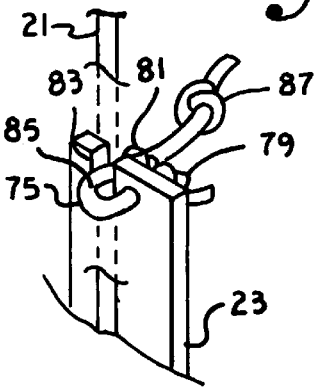

ARCHERY BOW HOLDER

BACKGROUND OF THE INVENTION

1. Field of the Invention

The present invention relates to the sport of archery and more particularly to a bow holder apparatus capable of being worn about the leg of an archer in either a standing or sitting position which can hold an archery bow at the ready until the archer is prepared to shoot.

2. Description of the Related Art

In the sport of archery, and more particularly in the sport of bow hunting, an archer must often wait for long periods of time for game to approach or until the archer is ready to shoot. During this waiting period, the archer may be standing or seated in a tree-stand or blind. It is desirable for the archer to always have his bow at the ready, but the bow can be heavy and uncomfortable to hold after a period of time. For this reason, a variety of bow holders have been developed to hold the archer's bow until he is ready to shoot.

Bow holders generally come in two basic types; those that are worn by the archer and those that are fastened to an object near at hand, such as a tree, a tree stand, or a chair. Wearable bow holders have the advantage of always keeping the bow close at hand, whereas a hunter using a bow holder attached to a tree or other stationary object may find that he has changed positions while waiting for game to approach and that his bow is out of reach at the critical instant.

Several styles of wearable bow holders have been known and used heretofore. U.S. Pat. No. 3,208,653 to R. W. Wallace discloses a bow support which comprises a strap worn about the archer's leg which has a pocket for the insertion of the tip of a recurve bow. This apparatus does help support the weight of the bow while holding it in a position approximating the shooting position, but this configuration has several disadvantages. First, this device will only accommodate the tip of a recurve bow. Compound archery bows having cams or eccentric wheels for multiplying the force applied to the bowstring are becoming more popular, and the pocket disclosed by Wallace will not admit the larger tip of a bow of this type. Secondly, the bow holder of Wallace will not completely support the bow and thereby free the archer's hands for other purposes. In order to keep the bow from dropping out of the bow support, the archer must keep at least one hand on the bow at all times.

Lyon et al., U.S. Pat. No. 4,103,807, discloses a bow holster which is similar to the bow support of Wallace except that it has been modified to support a compound bow. The apparatus has a leg strap, a larger holster or pocket to accept the end of a compound bow, and a support strap which attaches to the archer's belt. The device of Lyons also requires the archer to support the bow with one hand at all times.

U.S. Pat. No. 5,850,955 to Thomas D. Barr discloses a wearable bow holder of a different type. This device comprises a rigid U-shaped support with a large pouch affixed to the curved portion thereof. The free ends of the support are strapped to the archer's thigh, so that when the archer is in the seated position the pouch is open and extends the length of the archer's lower leg. A J-hook is provided on the bottom of the pouch to engage the archer's boot laces. The seated archer then places his bow in the pouch, which is large enough to accept one-third of the length of the bow. This design has the advantage of being able to support the bow while freeing up the archer's hands, but it has several disadvantages as well. First, this bow holder is only operational when the archer is seated; when the archer stands, the pouch collapses around his ankle and is no longer usable. The second problem is that the depth of the pouch makes it difficult to extract the bow quickly as the archer must lift the bow approximately two feet in order to clear the pouch. This movement may startle the game and an allow it time to escape before the archer can loose an arrow.

It is apparent that there remains a need for an archery bow holder that is wearable, allows the archer freedom to use his hands for other purposes, will accept either a recurve or compound bow, is useable in either the sitting or standing position, and allows the bow to be withdrawn from the holder with little movement or effort. Heretofore there has not been an archery bow holder available with the advantages and features of the present invention.

SUMMARY OF THE INVENTION

The present invention comprises an improved archery bow holder adapted to be worn about the leg of an archer. The bow holder includes a bow support member adapted to support a lower end of a bow, and a bowstring retainer adapted to engage and secure a bowstring of the bow to the bow holder. The support member and the bowstring retainer are secured to a lower leg of the wearer.

The bow holder preferably includes a rigid upright frame with leg straps attached for fastening the frame to the calf of an archer. The bow support member is hingedly connected to the frame, which permits the support member to be pivoted between a retracted position, where it rests against the frame, and an operating position, where it extends outward from the frame. A brace is secured to the bow support member for use in holding it in the operating position and a lock is mounted to the frame to selectively hold it in the retracted position. A first receiver is formed in the bow support member for accepting an eccentric wheel or cam of a compound archery bow. The lower end of the compound bow has a pair of branches between which the eccentric wheel is mounted, and these branches are supported on portions of the bow support member extending on opposite sides of the receiver. A second receiver, which will accept the tip of a recurve type archery bow, is also formed on the bow support member.

The bowstring retainer is mounted to the upper end of the frame, and is designed to selectively engage the bowstring of an archery bow resting on the bow support member. When the bowstring is engaged by the bowstring retainer, the bow is securely supported by the bow holder, allowing the archer to use his hands for other purposes. The bowstring retainer can be released quickly and easily without noise or excessive movement which might scare away game.

The bow holder further includes a stabilizer which is connected to the lower end of the frame and is moveable between operating and traveling positions. In the operating position the stabilizer engages the archer's foot and prevents the bow holder from twisting around the archer's leg. In the traveling position the stabilizer folds back around the archer's ankle so that he can walk unimpeded.

OBJECTS AND ADVANTAGES OF THE INVENTION

The principal objects and advantages of the present invention include: providing a holder for an archery bow; providing such a bow holder which is wearable by an archer; providing such a bow holder which can be used with either a compound or recurve type bow; providing such a bow holder which can be used by an archer in either a standing or sitting position; providing such a bow holder which frees up the archer's hands for other purposes; providing such a bow holder which holds the bow in such a fashion that the bow can be quickly released from the holder with little effort or movement; providing such a bow holder which can be folded to allow the archer to walk or climb unimpeded; providing such a bow holder which is light weight and comfortable to wear; providing such a bow holder which is quiet and unobtrusive so that it will not startle game; and providing such a bow holder which is economical to manufacture, capable of long operating life and particularly well-adapted for the proposed usage thereof.

BRIEF DESCRIPTION OF THE DRAWINGS

FIG. 1 is a perspective view of an archery bow holder embodying the present invention being worn by a sitting archer and supporting a compound bow.

FIG. 2 is a side view of an archery bow holder embodying the present invention being worn by a standing archer showing the bow holder in its retracted or traveling position in solid lines and in its operating position in phantom lines.

FIG. 6 is an enlarged, fragmentary, perspective view of the archery bow holder showing the bowstring retainer fastened around a bowstring which is shown partially in phantom lines.

DETAILED DESCRIPTION OF THE PREFERRED EMBODIMENT

Figure 4:
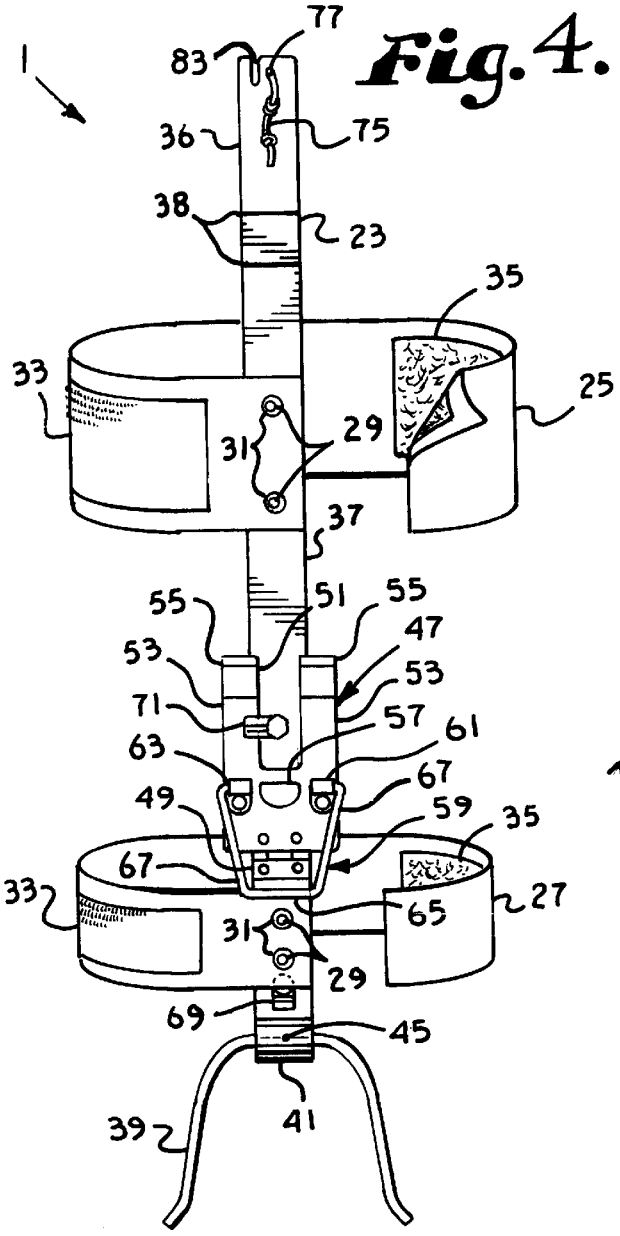
FIG. 4 is a front view of the archery bow holder showing the bow support member in the retracted position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference number 1 generally designates an archery bow holder embodying the present invention. The bow holder 1 is designed to be worn by an archer 3 to support a compound type archery bow 5, as shown in FIG. 1, or a recurve type archery bow 7, as shown in FIG. 3.

The compound bow 5 includes a central handle section or "riser" 9 having a pair of limbs 11 extending outwardly therefrom. The outermost end of each limb 11 has a notch 13 formed therein which defines a pair of branches 15. An eccentric wheel or cam 17 is rotatably mounted by means of an axle 19 between the branches 15. Both the compound bow 5 and the recurve bow 7 have a bowstring 21.

Referring to FIG. 4, the bow holder 1 includes an upright frame or base 23, which is preferably constructed of a strong, rigid lightweight material such as aluminum, fiberglass, carbon fiber, or other suitable material. An upper leg strap 25 and a lower leg strap 27 are fixedly connected to the frame 23; the connection may be accomplished by means of rivets 29 and backup plates 31. The upper strap 25 is substantially wider than the lower strap 27 because it carries more load. The straps 25 and 27 are made of a strong flexible material such as nylon webbing, and are provided with means for fastening the straps 25 and 27 about the calf of the archer 3. One appropriate means for fastening the straps 25 and 27 is by use of hook-and-loop material as shown in FIG. 4, with the hook material being designated as 33 and the loop material being designated as 35. The straps 25 and 27 could also be fastened with buckles, ties or other suitable means.

Figure 3:
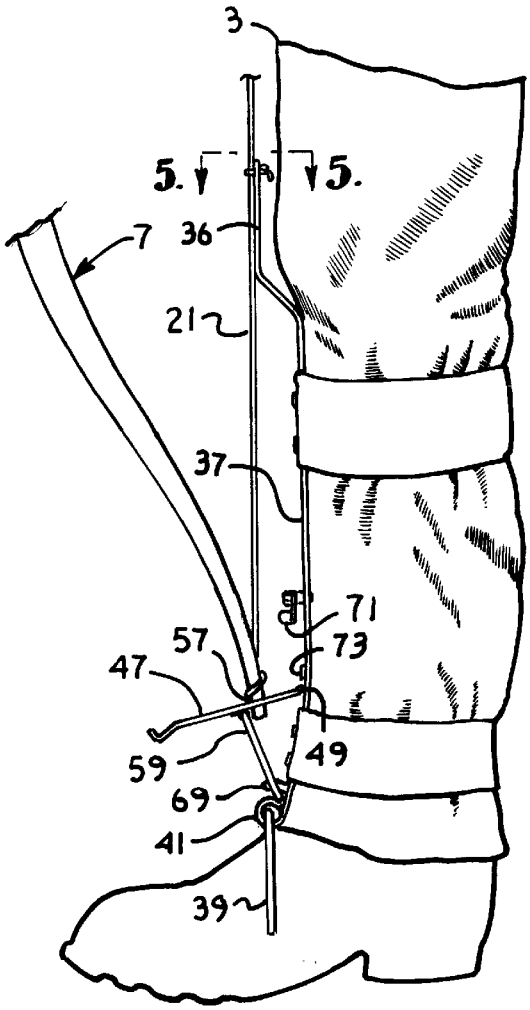
FIG. 3 is a side view of an archery bow holder embodying the present invention being worn by a standing archer and supporting a recurve bow.

As best seen in FIGS. 2 and 3, an upper length or section 36 of the frame 23 is displaced in a forward direction relative to a lower length or section 37 to provide clearance for the kneecap of the archer 3. The forward displacement of the upper section 36 is accomplished by two equal radius bends 38.

The bow holder 1 also includes a U-shaped yoke or stabilizer 39 which is connected to the bottom end of the bow holder frame 23. The bottom end of the frame 23 is bent to form a generally circular sleeve 41 which encircles a stabilizer bushing 43, which is manufactured out of nylon, polyethylene, or any other suitable material which will provide quiet and easy rotation of the stabilizer 39. A roll-pin 45 (see FIG. 4) is driven through a hole in the frame 23 which is perpendicular to the sleeve 41 and into a matching hole in the stabilizer bushing 43, thereby retaining the bushing 43 within the sleeve 41. The stabilizer 39 is rotatably secured in the stabilizer bushing 43, to permit rotation of the stabilizer 39 relative to the bow holder frame 23.

As shown in FIG. 2, the stabilizer 39 is rotatable between operating and traveling positions. In the operating position, the stabilizer 39 is oriented in a generally downward position so that it engages the foot of the archer 3 and prevents the bow holder 1 from twisting around the leg of the archer 3. In the traveling position, the stabilizer 39 is folded back around the ankle of the archer 3, allowing him to walk or climb unimpeded.

As best seen in FIG. 4, the bow holder 1 also includes a bow support member or fork 47, which is connected to the frame 23 by a hinge 49. The hinge 49 allows the bow support member 47 to be rotatable between an operating position, where it extends outward from the frame, and a retracted position, where it rests against the frame as shown in FIG. 2.

The bow support member 47 includes a first receiver 51 which is sized and shaped to accept the eccentric wheel or cam 17 of a compound archery bow 5. In the preferred embodiment, the first receiver 51 is in the form of a notch which defines two prongs or support platforms 53. The eccentric wheel 17 fits between the prongs 53, while the outboard extremities of the branches 15 of the bow 5 rest on the prongs 53. The forward extremity of each of the prongs 53 includes an upwardly extending stop 55 to better retain the bow 5 and prevent it from slipping off the prongs 53.

In alternative embodiments of the present invention, the first receiver 51 could take the form of a hole, a depression, a pocket, or any comparable shape, with the portions of the support member extending on opposite sides of the receiver serving as platforms to support the branches 15 of the compound bow 5. The exact configuration of the first receiver 51 is not critical, so long as the resulting bow support member 47 is capable of supporting and retaining an outboard end of the compound bow 5.

Referring again to FIG. 4, the bow support fork 47 also includes a second receiver or hole 57 which is located just rearward of the first receiver or notch 51. The second receiver 57 is sized and shaped to accept the outboard tip of a recurve archery bow 7. Because the bow support fork 47 includes both the first receiver or notch 51 and the second receiver or hole 57, the bow holder 1 can be used with either a compound bow 5 or a recurve bow 7.

The bow support fork 47 is preferably covered with a plastic or rubberized coating to prevent the bow 5 or 7 from being scratched by contact with the fork 47, and deaden any sound that may be produced by the bow 5 or 7 rattling against the fork 47.

A fork brace 59 is connected to the bow support fork 47 by fork support bearing sleeves 61 which allow the fork brace 59 to rotate relative to the fork 47. The fork brace 59 generally comprises a bail and includes a pair of pivot axles 63 which are rotatably secured in the bearing sleeves 61, a generally horizontal bottom member 65, and a pair of depending arms 67 which connect the pivot axles 63 to the bottom member 65.

The fork brace 59 braces the bow support fork 47 in its operating position, as shown in FIG. 3, by selectively engaging a fork brace retainer 69 which is fixedly connected to the bow support frame 23 at a point below the hinge 49 and immediately above the stabilizer sleeve 41. The fork brace retainer 69 comprises a catch or latch which is adapted to capture the bottom member 65 of the fork brace 59 and hold it against the stabilizer sleeve 41. The fork brace retainer 69 is preferably constructed of spring steel so that it will retain its shape after repeated contact with the fork brace 59.

A bow support fork lock 71 is pivotally attached to the bow holder frame 23 in a position where it is located between the prongs 53 of the bow support fork 47 when the bow support fork 47 is in its retracted position. The bow support fork lock 71 can be rotated so as to extend across a portion of one of the prongs 53 and thereby lock the bow support fork 47 in the retracted position as shown in FIG. 4.

A small pad 73 of adhesive-backed foam rubber, polyurethane, or similar material is secured to the frame 23 just above the hinge 49 connecting the support fork 47 to frame 23. The pad 73 cushions the contact between the frame 23 and the bow support fork 47 to prevent rattling of the two parts and to deaden any noise which might be produced thereby. This noise would be undesirable because it would tend to scare game which might be in the vicinity.

Figure 5:
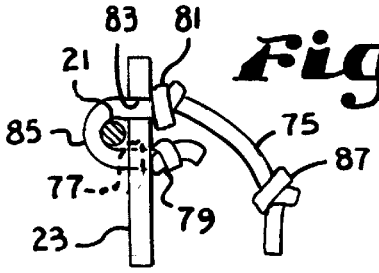
FIG. 5 is an enlarged, partial, top view of the archery bow holder showing the bowstring retainer fastened around a bowstring which is shown in a cross section taken generally along line 5—5 in FIG. 3.

The bow holder 1 further includes a bowstring retainer 75, as best seen in FIGS. 5 and 6, which is connected to the upper end of the bow holder frame 23. The bowstring retainer 75 comprises a thin strip of leather, a piece of cord, or similar material which is threaded through a hole 77 in the frame 23. The bowstring retainer 75 is knotted in three locations, with the first knot 79 serving to retain the bowstring retainer 75 within the hole 77. The second knot 81 is spaced a distance from the first knot 79 which is sufficient to allow the second knot 81 to selectively engage a notch 83 in the upper extremity of the frame 23, and thereby create a loop 85 in the bowstring retainer 75. The loop 85 is sized to selectively capture the bowstring 21 of the archery bow 5 or 7 resting on the bow support fork 47 and hold it against the bow holder frame 23. When the bowstring 21 is so captured by the loop 85 of the bowstring retainer 75, the bow 5 or 7 is securely held by the bow holder 1, and the archer 3 may let go of the bow 5 or 7 so that his hands are free to accomplish other tasks. In addition, with most bows 5 or 7, the arrow can be strung and supported by the bow 5 or 7 while the bow 5 or 7 is in turn supported by the bow holder 1.

The third knot 87 provides a gripping surface for the archer 3. In order to release the bow 5 or 7 from the bow holder 1, all the archer 3 has to do is pull up slightly on the knot 87, so that the bowstring retainer 75 is pulled out of the notch 83. The archer 3 can then simply lift the bow 5 or 7 off of the bow support fork 47, with an arrow already strung, and take his shot. Forward displacement of the upper section 36 of the bow support frame 23 provides easier access by the user's fingers to the third knot 87 to facilitate gripping of the third knot 87.

All of the surfaces of the archery bow holder 1 are preferably covered with a nonreflective finish so that they do not produce a glare that will startle game. A flat paint in black or a camouflaged color could be used for this purpose, and in addition, any aluminum parts could be anodized.

It is to be understood that while certain forms of the present invention have been illustrated and described herein, it is not to be limited to the specific forms or arrangement of parts described and shown. For example, although the bow holder 1 is generally shown as comprising a single assembly, it is foreseen that the bow holder 1 could be formed from two separate assemblies. A first assembly could include the bow support member or fork secured to a first strap, for securing the bow support member to the wearer's leg, and a second assembly could include the bowstring retainer secured to a separate strap for securing the bowstring retainer to the wearer's leg above and separated from the first assembly.

It is foreseen that instead of straps, the frame 23 or assemblies could be securable to a wearer's leg by a wide range of means, including but not limited to elastic sleeves, or semi-flexible plastic cuffs. Further, although the frame or base member 23 is described, in the preferred embodiment as being formed from a relatively rigid material, it is foreseen that the base member 23 could be formed from flexible material, such as nylon webbing, to which the bow support member and the bow restraining member could be secured.

What is claimed and desired to be secured by Letters Patent is as follows:

1. An archery bow holder including:

a) a bow support member adapted to support a lower end of a bow; said bow support member securable to a leg of an archer such that the weight of the bow is entirely supported by the leg of the archer; and b) a bowstring retainer securable to the leg of the archer above said bow support member and adapted to secure a bowstring of said bow to said holder.

2. The archery bow holder as in claim 1, wherein said bow support member includes a recurve bow receiver sized and shaped to accept and retain a lower end of a recurve bow.

3. The archery bow holder as in claim 1, wherein said bow support member is moveable between retracted and operating positions.

4. The archery bow holder as in claim 1, further comprising a stabilizer selectively engaging a foot of the archer for preventing said archery bow holder from twisting around the leg of the archer to which it is secured.

5. The archery bow holder as in claim 1, wherein said bow support member and said bowstring retainer are attached to a base frame securable to the lower leg of the archer such that said base frame extends upwardly from said bow support member toward the archer's knee, said base frame being displaced outwardly to provide clearance for the knee and said bowstring retainer being positioned on said base frame above the archer's knee when the archer is in a seated position.

6. An archery bow holder including:

a) a bow support member adapted to support a lower end of a compound bow which includes a pair of limbs, each limb having a pair of branches formed on an outer end thereof, and an eccentric wheel rotatably mounted between said branches by an axle, said bow support member comprising a pair of support platforms extending on opposite sides of a compound bow receiver sized and shaped to receive a portion of said eccentric wheel; said support platforms selectively supporting lower ends of said branches; said bow support member securable to a leg of an archer; and b) a bowstring retainer securable to the leg of the archer above said bow support member and adapted to secure a bowstring of said bow to said holder.

7. The archery bow holder as in claim 6, wherein said bow support member further includes a recurve bow receiver sized and shaped to accept and retain a lower end of a recurve bow.

8. The archery bow holder as in claim 6, wherein said bow support member is moveable between retracted and operating positions.

9. The archery bow holder as in claim 6, wherein said compound bow receiver comprises a notch formed in an outer end of said support member.

10. The archery bow holder as in claim 9, wherein each of said support platforms includes an upwardly extending stop formed on an outer end thereof.

11. The archery bow holder as in claim 6, further comprising a stabilizer selectively engaging a foot of the archer for preventing said archery bow holder from twisting around the leg of the archer to which it is secured.

12. The archery bow holder as in claim 11, wherein said stabilizer is moveable between operating and traveling positions, said stabilizer engaging the foot of the archer in the operating position and said stabilizer allowing the archer to walk unimpeded in the traveling position.

13. The archery bow holder as in claim 11, wherein said stabilizer is moveable between operating and traveling positions, said stabilizer engaging the foot of the archer in the operating position and said stabilizer allowing the archer to walk unimpeded in the traveling position.

14. An archery bow holder comprising:

a) a base removably securable to a leg of an archer and having an upper end and a lower end;

b) a bow support member hingedly connected at an inner end to said base and moveable between retracted and operating positions; said bow support member having a first receiver formed therein dividing said bow support member into a pair of bow support platforms each sized and shaped to support a branch of a lower end of a compound bow; and c) a bowstring retainer connected to said bow holder base proximate said upper end thereof, said bowstring retainer selectively engaging a bowstring of an archery bow supported on said bow support member.

15. The archery bow holder as in claim 14, wherein said bowstring retainer comprises a cord secured at a first point to said base and selectively securable to said base at a second point such that said bowstring is held against said base by said cord.

16. The archery bow holder as in claim 14, wherein a second receiver is formed in said bow support member and is sized and shaped to receive a lower end of a recurve bow for retaining the lower end of the recurve bow therein.

17. The archery bow holder as in claim 14, further comprising a stabilizer connected to the lower end of said base, said stabilizer being adapted to selectively engage a foot of the archer and thereby prevent said archery bow holder from twisting around the leg of the archer to which it is secured.

18. An archery bow holder removably securable to a leg of an archer, said holder comprising:

a) a frame having an upper end and a lower end;

b) a leg strap secured to said frame and adapted for removably securing said frame to the leg of the archer;

c) a bow support fork having inner and outer ends, said inner end hingedly connected to said frame, said bow support fork being moveable between retracted and operating positions, said outer end of said bow support fork having a notch formed therein and dividing said fork into a pair of support platforms, said support platforms sized and shaped to support a lower end of a compound archery bow;

d) a fork brace secured to said bow support fork;

e) a fork brace retainer fixedly secured to said bow holder frame; said fork brace selectively advanceable into engagement with said fork brace retainer to retain said bow support fork in the operating position; and f) a bowstring retainer connected to said bow holder frame proximate the upper end thereof, said bowstring retainer selectively engaging a bowstring of an archery bow resting in said bow support fork.

19. The archery bow holder as in claim 18, further comprising a U-shaped stabilizer pivotally connected to said bow holder frame at said lower end thereof, said U-shaped stabilizer pivotal between an operating position wherein said U-shaped stabilizer extends around an upper portion of a foot of the archer and a traveling position wherein said U-shaped stabilizer is pivoted out of engagement with the foot of the archer.

20. The archery bow holder as in claim 18, further comprising a recurve bow receiver formed in said bow support fork inward of said notch, said recurve bow receiver sized and shaped to receive a lower end of a recurve bow for receiving and retaining the lower end of the recurve bow therein.

21. An archery bow holder including:

a) a relatively rigid base securable to a leg of an archer below a knee thereof such that an upper end of said base extends above the archer's knee when the archer is in a seated position; said base having a bow support secured to a lower end of said base, said bow support adapted to support a lower end of a bow; and b) a bowstring retainer secured to said base proximate an upper end thereof and adapted to secure a bowstring of said bow to said holder.

22. The bow holder as in claim 21 wherein an upper portion of said base is displaced outwardly relative to a lower portion of said base to provide clearance for the knee of the archer.

* * * * *